US008240127B2

(12) United States Patent
Wahl et al.

(10) Patent No.: US 8,240,127 B2
(45) Date of Patent: Aug. 14, 2012

(54) METHOD FOR THE VOLTAGE-CONTROLLED PERFORMANCE REGULATION OF THE HEATING OF AN EXHAUST-GAS PROBE

(75) Inventors: Thomas Wahl, Pforzheim (DE); Walter Strassner, Schorndorf (DE); Lothar Diehl, Gerlingen (DE); Stefan Rodewald, Ditzingen (DE); Juergen Sindel, Vaihingen/Enz (DE)

(73) Assignee: Robert Bosch GmbH, Stuttgart (DE)

( * ) Notice: Subject to any disclaimer, the term of this patent is extended or adjusted under 35 U.S.C. 154(b) by 316 days.

(21) Appl. No.: 11/665,463

(22) PCT Filed: Jan. 27, 2006

(86) PCT No.: PCT/EP2006/050495

§ 371 (c)(1),
(2), (4) Date: Apr. 16, 2007

(87) PCT Pub. No.: WO2006/087261

PCT Pub. Date: Aug. 24, 2006

(65) Prior Publication Data

US 2008/0087005 A1 Apr. 17, 2008

(30) Foreign Application Priority Data

Feb. 15, 2005 (DE) ..... 10 2005 006 760

(51) Int. Cl.
*F01N 3/00* (2006.01)

(52) U.S. Cl. ..... 60/274; 60/284; 60/276; 60/277; 60/300; 204/408; 204/421; 204/424; 204/425

(58) Field of Classification Search ..... 60/284, 60/274, 276, 277, 300; 73/114.69, 114.71–114.73; 123/697; 204/408, 421, 424, 425
See application file for complete search history.

(56) References Cited

U.S. PATENT DOCUMENTS

| | | | | |
|---|---|---|---|---|
| 5,156,044 | A * | 10/1992 | Benninger et al. | 73/114.69 |
| 5,353,775 | A * | 10/1994 | Yamashita et al. | 123/686 |
| 5,700,367 | A * | 12/1997 | Yamada et al. | 205/785 |
| 5,719,778 | A * | 2/1998 | Suzumura et al. | 700/207 |
| 6,083,369 | A * | 7/2000 | Tanigawa | 204/424 |
| 6,099,717 | A * | 8/2000 | Yamada et al. | 205/784.5 |
| 6,336,354 | B1 * | 1/2002 | Suzuki et al. | 73/31.05 |
| 6,921,883 | B2 * | 7/2005 | Kato et al. | 219/494 |
| 2001/0054608 | A1 * | 12/2001 | Ohkuma et al. | 219/205 |
| 2002/0078938 | A1 * | 6/2002 | Hada et al. | 123/697 |
| 2004/0026408 | A1 * | 2/2004 | Morinaga et al. | 219/497 |

FOREIGN PATENT DOCUMENTS

DE 28 05 805 A1 8/1979

(Continued)

*Primary Examiner* — Thomas Denion
*Assistant Examiner* — Brandon Lee
(74) *Attorney, Agent, or Firm* — Merchant & Gould P.C.

(57) ABSTRACT

The invention relates to a method for the voltage-controlled performance regulation of the heating of an exhaust-gas probe in the exhaust system of an internal combustion engine. The aim of the invention is to provide a method in which the operating temperature of the probe is achieved in the shortest possible time without damage to the probe. To achieve this, the heating voltage during the heating phase of the probe is rapidly brought up to a high temperature in a start phase in relation to a subsequent phase, or a dramatic leap in temperature is achieved, preferably up to the full operating voltage and the heating voltage is then continuously or quasi-continuously reduced.

4 Claims, 3 Drawing Sheets

FOREIGN PATENT DOCUMENTS

Figure 1:
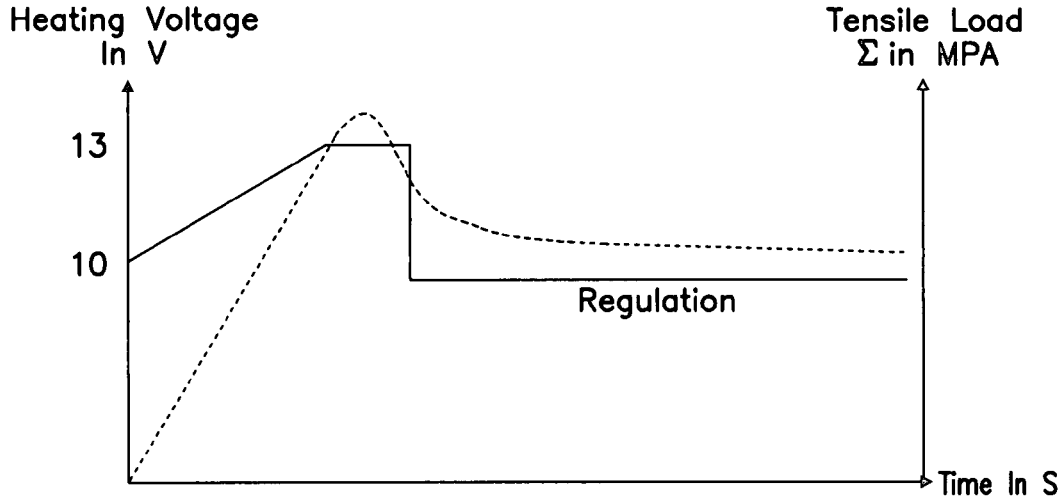

| | | | |
|---|---|---|---|
| DE | 40 19 067 | A1 | 12/1991 |
| JP | 5202785 | | 8/1993 |
| JP | 10239269 | | 9/1998 |
| JP | 2002 257779 | | 9/2002 |
| JP | 2004-360526 | | 12/2004 |

* cited by examiner

METHOD FOR THE VOLTAGE-CONTROLLED PERFORMANCE REGULATION OF THE HEATING OF AN EXHAUST-GAS PROBE

The mixture regulation of internal combustion engines results today as a function of the combustion and the composition of the exhaust gas resulting from it. For this purpose one or more sensors are disposed in the exhaust gas of the internal combustion engine, which typically determine the residual oxygen content of the exhaust gas. The quality of combustion can be ascertained on the basis of this measurement. This measurement signal serves together with other parameters, such as number of revolutions per minute, air flow or throttle valve angle, to allocate the fuel by way of a control or regulating unit.

As is made known in the German patent DE 28 05 805, a sensor must have an adequate operating temperature. Therefore, a sensor signal is not supplied in the warm-up phase of the sensor, for example after starting the motor. Until an adequate sensor temperature is reached, the fuel regulation is, thus, replaced by a fuel control. This results in no optimal combustion values being achieved during this time.

In order to minimize the time taken to achieve an adequate operating temperature of the sensor, they are equipped with electric auxiliary heaters. The control of the heating output is thereby to be so designed, that the operating temperature is achieved as quickly as possible without damaging or destroying the sensor in the process. Strong temperature gradients within the sensor are to be seen as critical factors in regard to a damaging of the sensor. These can lead to stress cracks due to the variable thermal expansion of the sensor resulting from them.

In the case of planar wideband lambda sensors, the heater within the sensor is, for example, insulated by means of an $Al_2O_3$ layer or an $Al_2O_3$ insulating foil from the sensor element. The sensor is in this way warmed from the inside out. If in the process a heating rate is selected which is too high, the temperature gradient from within the sensor to the surface area is so large, that cracks can emanate from the surface area of the sensor which is under tensile stress.

In order to avoid this, the heating voltage upon activation is operated as a ramp from a suitable activation voltage, for example 10V, to the complete heating voltage, for example 13V. In so doing the ramp is then first activated, when the dew point is exceeded in the exhaust gas system. Otherwise the moisture hitting the sensor would cool the surface area of the sensor down so drastically, that this would thus lead to the large temperature gradients with the previously described consequences.

In the case of this form of heating the sensor, it has been proven to be disadvantageous, that the operating temperature of the sensor is first achieved relatively late on account of the ramp and the delay in the dew point. When a heating of the sensor occurs as quick as possible and consequently a short ramp results, the temperature gradient and correspondingly the mechanical stress in the surface area of the sensor display a maximum upon achievement of a maximum heating voltage. The ramp is to be so designed, that this maximum mechanical stress lies well beneath the innate strength of the sensor material.

A mechanism for the control and regulation of a heater, especially the heater of a sensor in the exhaust gas of an internal combustion engine, is known from the German patent DE 40 19 067, whereby the start-up signal for the heater is initiated by an event occurring chronologically before the actuation of the ignition switch (ignition lock). This event can be the opening of a door of the vehicle or can be initiated by means of a contact in the driver's seat.

After starting the motor, the sensor must, therefore, no longer pass through the entire temperature range from cold up to the operating temperature, but is already preheated, whereby the previously described heating ramp can accordingly be passed through more quickly. Nevertheless the previously described disadvantage remains, that the greatest mechanical stresses arise at the end of the ramp, which limits the maximally admissible slew rate of the heat output.

The task underlying the invention is to provide a procedure for the heating of a sensor in the exhaust gas of an internal combustion engine, in which the operating temperature of the sensor is achieved in the shortest amount of time without the sensor being damaged in the process.

The task pertaining to the procedure is thereby solved, in that in a beginning phase of the heat-up phase of the heater, the heating voltage is brought either very quickly to a high value with respect to a following phase or precipitously brought to that high value, which is preferably the operating voltage, and subsequently the heating voltage is continuously or virtually continuously reduced. In so doing, a too quick rise in temperature in the sensor is prevented, which would allow the tensile stresses to rise drastically in such a way, that they would exceed the strength of the ceramic and cause cracks in the surface area of the sensor element.

Provision is made in a preferred variation, in that the reduction in the heating voltage occurs preferably in steps between 0.1 V/s and 0.3 V/s. In so doing, smaller tensile stresses arise in the surface area, because the maximally possible temperature difference between the surface area and the interior of the lambda sensor is lowered.

In regard to sensor elements with a large heat capacity, the invention has the advantage, in that the reduction occurs up to a specified constant value or up to the complete cut-out of the sensor heating.

An embodiment allows for the ramp shaped heating voltage to be so designed, that the tensile stresses, which arise in the surface area of the sensor, assume by means of the heat-up phase approximately a constant value, which is smaller than the intrinsic material strength of the material of the surface area of the sensor. In so doing, the heat output that has been yielded can reach the surface area of the sensor early in the form of a heat source and thereby lower the maximum temperature gradient between the surface area and the interior of the sensor. This has a positive effect on the longevity of the sensor.

As the danger of water transport in the exhaust gas system increases drastically, when the motor is being started, the invention allows the impression of a large heating voltage and the ensuing reduction of the heating voltage to occur when starting the motor. The voltage ratios invert thereby in the sensor element. The compressive stresses resulting in the area surrounding the heater produce only small tensile stresses in the surface area of the sensor element.

In order that the sensor element can heat to approximately 200 degrees Celsius by way of the small heating output, provision is made for the sensor to be preheated by means of a signal occurring chronologically before the starting of the motor. This signal occurs preferably at the opening of the driver's door or the insertion of the ignition key.

An embodiment allows for the preheating to occur at a small actual heating voltage, preferably at 2 V. The preheating is so selected, that any amount of water cannot lead to a destruction of the sensor element.

An especially simple embodiment allows for the preheating to be implemented in stages. This has the advantage that the waiting time before starting the motor is significantly shortened. Provision is thereby made that an initial heating output is set at a small fraction of the total heating output at the occurrence of a signal chronologically before the starting of the motor, and a second larger heating output is set at a larger fraction of the total heating output at the occurrence of a subsequent second signal before the starting of the motor.

A configuration of the invention provides for the heating output to be reduced respective to the start-up voltage. This is based on the fact that as soon as the motor starts up, the danger of a water transport in the exhaust gas system increases. The voltage ratios in the sensor element invert in the sensor element and the compressive stresses, which arise from that, produce consequently small tensile stresses on the surface area of the sensor element.

DRAWINGS

The invention is explained below using an example of embodiment which is depicted in the figures. They show:

FIG. 1: a heating ramp and a tensile stress progression according to the state of the art.

Figure 2:
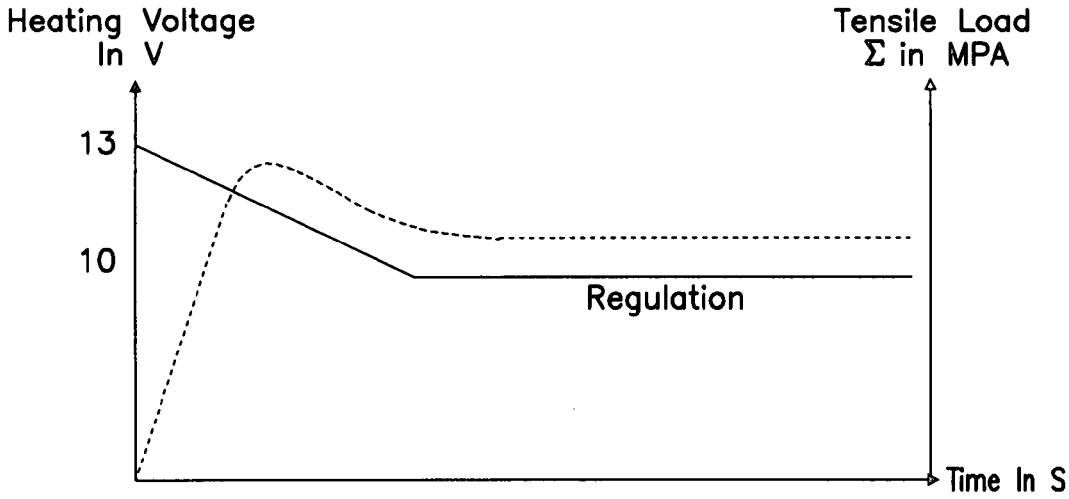

FIG. 2: a heating ramp which is concentrated at the outset as well as the associated tensile stress progression.

Figure 3:
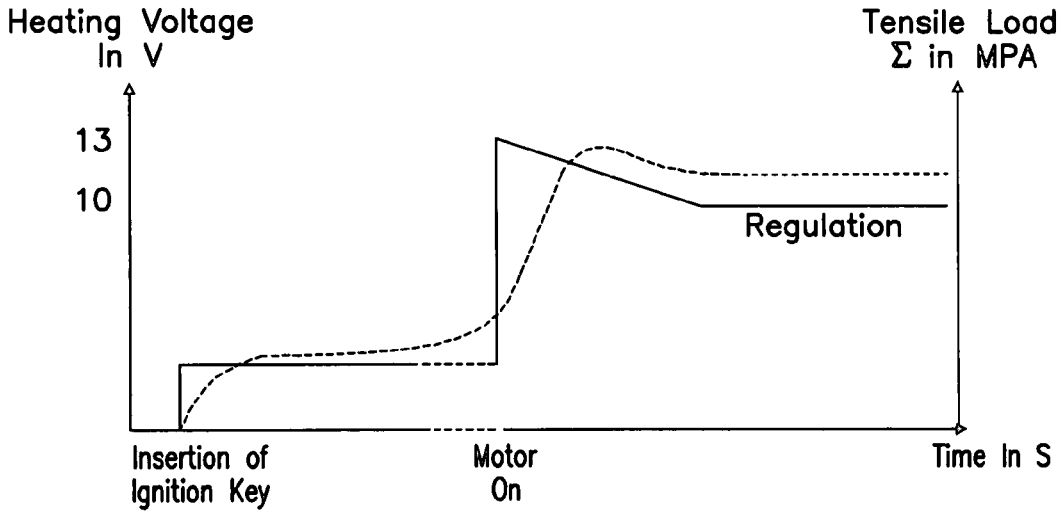

FIG. 3: a depiction of the preheating and the tensile stress progression while inserting the ignition key.

Figure 4:
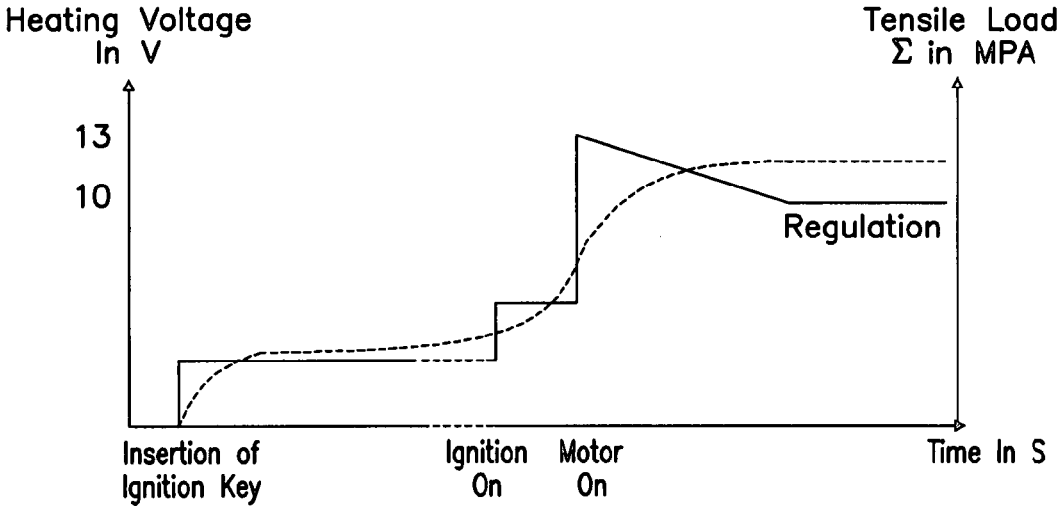

FIG. 4: a depiction for the additional heating-up while the ignition is engaged as well as the associated progression of the tensile stresses.

Figure 5:
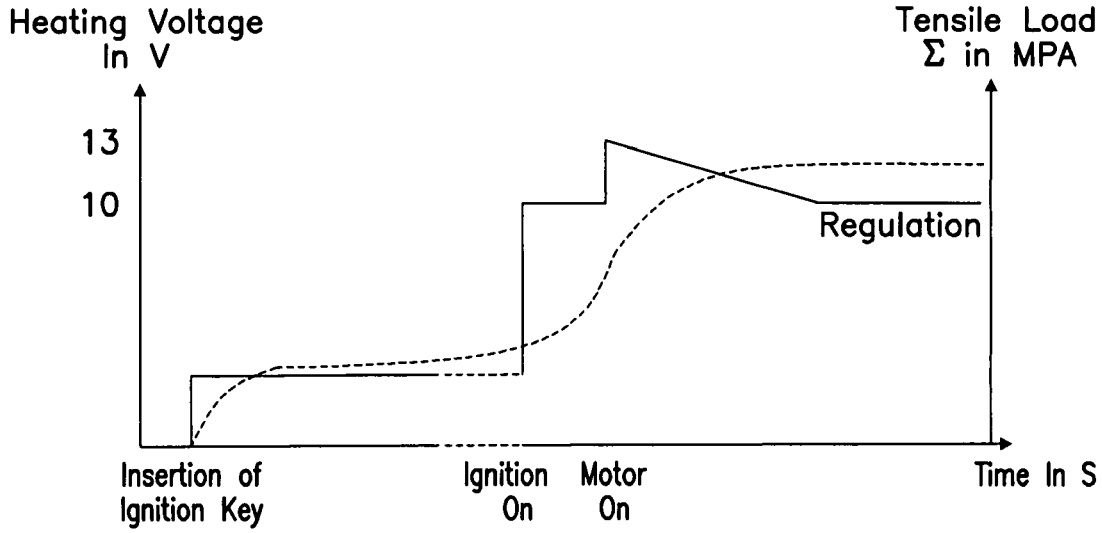

FIG. 5: a depiction of the reduction of the heating output while starting the motor and the tensile stress progression.

FIG. 1 illustrates a heating ramp according to the state of the art. It is thereby to be recognized, that during the activation of the heating voltage, this voltage is steadily raised from a suitable starting voltage (in this instance: 10V) to the complete amount of heating voltage, which is available (in this instance: 13V). The heating ramp is in this instance then first activated, when the dew point is exceeded in the exhaust gas system; otherwise contingent moisture drastically cools down the surface area of the sensor and can lead to cracking. As soon as the motor is started, the heating output is again reduced. This occurs thereby according to the state of the art, in that the target internal resistance of the Nernst cell indicates that the operating temperature has been reached. The voltage ratios in the sensor element invert at the same time and no tensile stresses are further produced on the surface area of the sensor element.

Furthermore, the tensile stress is listed in MPa on the right side of FIG. 1. The progression of the tensile stress shows, that, although the voltage is reduced, a fast light-off is also simultaneously possible.

FIG. 2 shows a heating ramp which is concentrated at the outset, which begins with total operating voltage. The heating voltage is lowered along the ramp with a low rate. In this instance, too, the ramp again is so designed, that the simulated tensile stress in the surface area of the sensor element is built up at the earliest possible moment. The tensile stress remains than constantly at a value, which is the result of the intrinsic strength of the material and a security factor. Also, in this instance, the internal resistance of the Nernst cell is used to achieve the operating temperature.

In FIG. 3 the preheating resulting from the insertion of the ignition key into the ignition, respectively the opening of the driver's door, is depicted. Already at the occurrence of these events, the sensor is clocked with a small actual heating voltage. The sensor element warms itself up thereby by way of the small heating voltage to approximately 200 degrees Celsius. This temperature is selected in accordance with the material composition, so that any amount of water cannot lead to a destruction of the sensor element. The tensile stresses behave thereby in a similar fashion. The tensile stresses increase only incrementally due to the low heating. If the motor were to be started then, the tensile stresses would act analogous to those in FIG. 2.

FIG. 4 describes an additional heating process, when switching on the ignition. As switching on the ignition indicates the immediately ensuing starting of the motor, heating is performed with an increased heating output in still air. If the motor is now started, the heating would jump to its maximum value and then adjust itself according to the internal resistance of the Nernst cell to the operating temperature and in so doing to the operating voltage. The regulation follows thereby again the previously described heating ramp. Also, in this instance the tensile stresses increase in correspondence with the different heating outputs only slowly, which has a positive effect on the longevity of the sensor element.

In FIG. 5 the reduction of the heating output when starting the motor is shown. The danger of water transport in the exhaust gas system increases dramatically, as soon as the motor is started. In order to protect the sensor element from tensile stresses, the heating output along the ramp is again reduced. In so doing, the voltage ratios in the sensor element invert. The area surrounding the heater warms up very quickly and a compressive stress is formed, which, however, cannot produce any harmful tensile stresses on the surface area of the sensor element. This also reveals itself in the progression of the tensile stresses drawn into the figure.

The invention claimed is:

1. A method for a voltage controlled output adjustment of a sensor heater in an exhaust gas system of an internal combustion engine, the method comprising:

preheating a sensor upon receiving a signal chronologically before starting of the internal combustion engine, as a result of opening a door of a vehicle or the insertion of an ignition key, wherein preheating occurs with a low actual heating voltage, selected so that any amount of water cannot lead to a destruction of the sensor element, and wherein the preheating is implemented in stages; and wherein preheating includes setting an initial heating output at a smaller fraction of a total heating output, at ⅛ of the total heating output, at the occurrence of a signal chronologically before starting of a motor; and a second higher heating output is set at a larger fraction of the total heating output, at ¼ of the total heating output, at the occurrence of a subsequent second signal before the starting of the internal combustion engine;

thereafter switching a heating voltage to a maximum value greater than a constant sensor operating voltage during a heat-up phase of the heater, wherein increasing the heating voltage such that tensile stresses arising in a surface area of the sensor assume a constant value less than an intrinsic material strength of the surface area material of the sensor across the heat-up phase;

immediately reducing the heating voltage from the maximum value at a linear rate to the constant sensor operating voltage, wherein increasing the heating voltage to the maximum value and reducing the heating voltage occur with the starting of the internal combustion engine; and maintaining the heating voltage at the constant sensor operating voltage.

2. A method according to claim 1, wherein reducing the heating voltage at the linear rate occurs in steps between 0.1 V/s and 0.3 V/s.

3. A method according to claim 1, wherein reducing the heating voltage results up to a specified constant value or up to a complete cut-off of the sensor heater.

4. A method according to claim 1, wherein reducing includes reducing the heating output respective to a start-up output after starting of the internal combustion engine.

* * * * *